US006588350B1

(12) United States Patent
Somers

(10) Patent No.: US 6,588,350 B1
(45) Date of Patent: Jul. 8, 2003

(54) AUTOMATIC COAL STOKER WITH INCREASED SENSIBLE HEAT OUTFLOW

(75) Inventor: George E. Somers, Pottsville, PA (US)

(73) Assignee: Keystoker Inc., Sch. Haven, PA (US)

( * ) Notice: Subject to any disclaimer, the term of this patent is extended or adjusted under 35 U.S.C. 154(b) by 0 days.

(21) Appl. No.: 10/062,501

(22) Filed: Feb. 5, 2002

(51) Int. Cl.[7] ..... F23B 7/00

(52) U.S. Cl. ..... 110/233; 110/110; 126/67; 126/68

(58) Field of Search ..... 110/193, 110, 110/102, 233, 104 R; 126/61, 79, 67, 68, 73, 77

(56) References Cited

U.S. PATENT DOCUMENTS 1,808,487 A * 6/1931 Ahlberg ..... 126/368
4,537,140 A 8/1985 Baker
4,545,360 A * 10/1985 Smith et al. ..... 126/76
4,565,184 A * 1/1986 Collins et al. ..... 126/368
4,656,956 A * 4/1987 Flickinger et al. ..... 110/233
4,662,290 A * 5/1987 Potts ..... 110/109
4,677,965 A * 7/1987 Duerichen ..... 126/76
4,803,973 A * 2/1989 Harman ..... 126/73
4,941,451 A * 7/1990 Gilham ..... 126/77
5,123,360 A * 6/1992 Burke et al. ..... 110/233
5,133,266 A * 7/1992 Cullen ..... 110/233
5,243,963 A * 9/1993 Riener ..... 126/107
5,297,493 A * 3/1994 Nuesmeyer et al. ..... 110/233
5,343,819 A * 9/1994 Charest ..... 110/233
5,429,110 A * 7/1995 Burke et al. ..... 126/25 R
5,603,312 A * 2/1997 Champion et al. ..... 126/77
5,680,855 A * 10/1997 Ko ..... 126/68

* cited by examiner

*Primary Examiner*—Ira S. Lazarus
*Assistant Examiner*—K. B. Rinehart
(74) *Attorney, Agent, or Firm*—A. R. Eglington

(57) ABSTRACT

An automatic coal stoker is provided with internal means to increase the sensible heal outflow from the operating stoker, which means comprises a modified stoker housing that provides a first combustion chamber and an abutting second chamber for induced air heat exchange with the hot combustion gases. A tubular means is disposed in the second chamber which intakes the combustion gases to be vented and extracts much of their sensible heat, and then directs by forced convection, the heated air useful to the stoker environment, while venting the spent combustion gases to the standard flue means.

10 Claims, 6 Drawing Sheets

AUTOMATIC COAL STOKER WITH INCREASED SENSIBLE HEAT OUTFLOW

CROSS-REFERENCE TO OTHER APPLICATIONS

None. This is an examinable patent specification submitted for a filing receipt under Code Section 111(*a*).

BACKGROUND OF THE INVENTION

In an automatic coal stoker of Potts (U.S. Pat. No. 4,662,290 of May 5, 1987) employs the pusher assembly, operated by a cam assembly 24, which reciprocally shifts step-like protuberance 58 and provides an enshrouded pusher which is resistant to attacks of such coal acids. The intermittent pusher assembly of the Potts patent, and incorporated by reference here, is an ancillary feature of the present invention. The state of the art in the Potts device (1987) includes long established perforations 32 for fire grate 30, which grate may be an integral member, as depicted, or may be composed of two more grate modules that aid in loading of the device.

It is axiomatic with coal stoker type furnaces that much of the sensible heat provided by this exothermic coal combustion is wasted as it escapes the ambient area being warmed by the flue conduit gases venting to the outside. This has been confirmed by measured combustion gas temperatures in the flue of the Potts—290 patent, ranging as high as 350 degrees F. It would be useful to capture more of the furnace generated heat that is now vented with combustion gases, provided that the efficiency of coal combustion, and the isolation of the toxic gases from the environment, can be maintained with an introduction of augmented sensible heat extraction means.

It is a principal object of the invention to provide a separate heat exchange means within stoker housing which efficiently extracts appreciably more sensible heat from the combustion gases just prior to their safe dispersal via the flue conduit, augmenting substantially the established radiant heating benefit.

It is a major object of the invention to provide a heat exchanger means disposed within a discrete second chamber that is hermetically sealed from the combustion-loaded gases flowing from of the first chamber.

It is still another object of the invention to draw toxic gases more uniformly from the combustion first chamber to a means for extracting much of their sensible heat normally being vented to the atmosphere for user safety.

A further object of the invention is to burn with a deeper fire bed, extracting greater sensible heat from the coal and producing ashes of a more powder-like consistency.

A still further object of the invention is to provide an ancillary induced air cooling means that reduces the surface temperature of the glassed access door and which further inhibits glass smudging by continuous air stream washing.

A further object of the invention is to provide a coal stoker serving as a mini-furnace whereby the extra sensible heat being generated in the improved stoker can also be funneled from the heat venting chamber via a separate conduit to another area, the heated air flow being within the power of the stoker convection blower means.

Other objects and advantages and features of the invention will be apparent to those skilled in the art from the following description taken in conjunction with the accompanying drawings and specification.

SUMMARY OF THE INVENTION

Figure 1:
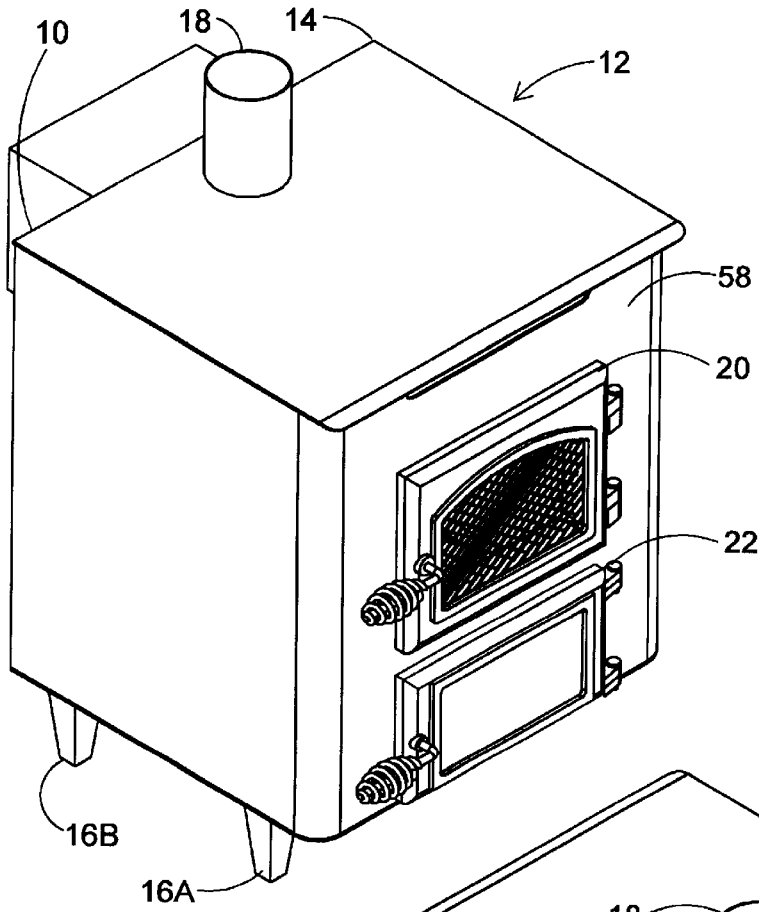
FIG. 1 is a front face, perspective view of the automatic stoker of the present invention.

According to the present invention, there is provided in a motorized coal stoker housing including a coal feed hopper with a lower forward passage, a base box forming an ash pit, a rearward ramp adapted to receive coal from the bottom of the hopper, and a pusher assembly disposed in the lower forward passage, eccentric movement means operably connected to the pusher assembly for causing reciprocating action, and a forward fire grate for receiving particulate coal incrementally from the pusher means, the improvements comprising: the stoker housing further comprising a larger and forward first chamber and a hermetically sealed smaller and rearward second chamber; a first chamber having closed sidewalls, a closed top wall, a front facing vertical panel perforated for intermittent user access, and a vertical inner back wall adapted to receive a coal stoker and coal firebox assembly; an exit portal means proximal the inner back wall adapted to conduct coal combustion gases from the first chamber to: (ii) a tubular first means disposed in the second chamber and operatively interconnecting between the exit portal means and a flue conduit for cooled combustion gases, the first means serving to exchange the sensible heat of the combustion gases with a contained forced air flow entering the second to chamber, thereby to provide a heated forced air outflow proximal the uppermost end of the stoker housing serving to warm the housing environment; and, (ii) a first blower means to introduce forced air flow proximal to the bottom of the second chamber and to allow flow therethrough, so as to vent heated forced air proximal to the upper and forward end of the second chamber and outwardly into the ambient surroundings.

In a second embodiment wherein the coal stoker has a glass insert frontal door, a washing and cleaning assembly is provided adjacent the frontal panel of the stoker housing comprising: a second pair of tubular conduits, one in each front corner of the front panel, each conduit having their lower longitudinal end open to the ambient atmosphere, and with their upper longitudinal ends connecting to a horizontal second manifold positioned intermediate of the heated air vent point and the upper sill of the fire box exit door; and, the lower surface of the second manifold being provided with ports that direct the induced air flow along the lateral peripheries of the fire box access door for cooling and cleaning purposes.

In a third embodiment of the coal stoker, the first conduit means for heat exchange comprises a first pair of opposing conduit members disposed in the second chamber separately connecting at the lower ends thereof with the bottom of the first chamber and jointly connecting the upper ends thereof with a first manifold located in the upper section of the second chamber, which first manifold is functionally connected to a combustion gases exhaust flue conduit, such that venting combustion gases are precluded from leaking into the second chamber, while substantially useful sensible heat is extracted.

DETAILED DESCRIPTION OF THE INVENTION

Referring now to the drawing, and to FIG. 1 in particular, there is provided a coal-fired, automatic stoker 12 having the improved air circulation system of the present invention. It comprises an upright, rectangular box 14, floor offset on raised upright corner legs 16A/D, and a conventional, top surface, mounted vertical chimney or flue 18. The upper front section of the stove presents a hinged, transparent door 20, which give user access for clearing of the fire grate (not seen), and a second hinged lower imperforate door 22, for accessing an ash box (not seen) to effect periodic dumping of collected ash. The chimney 18 is preferably located proximal to the rearward linear edge of the stoker.

Figure 2:
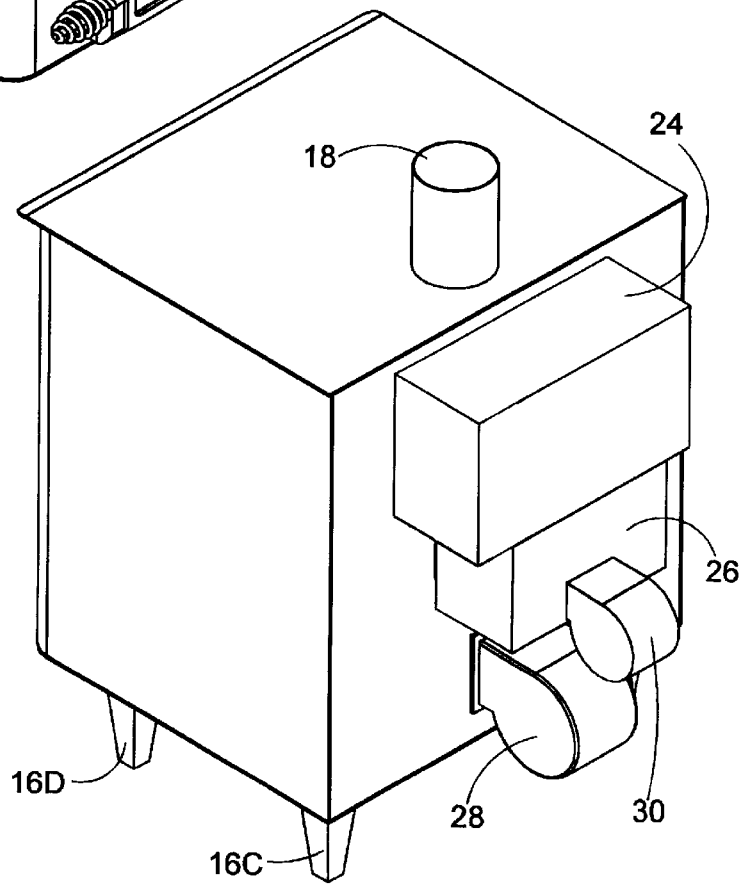
FIG. 2 is a rear face, perspective view of the stoker of the present invention.
Figure 3:
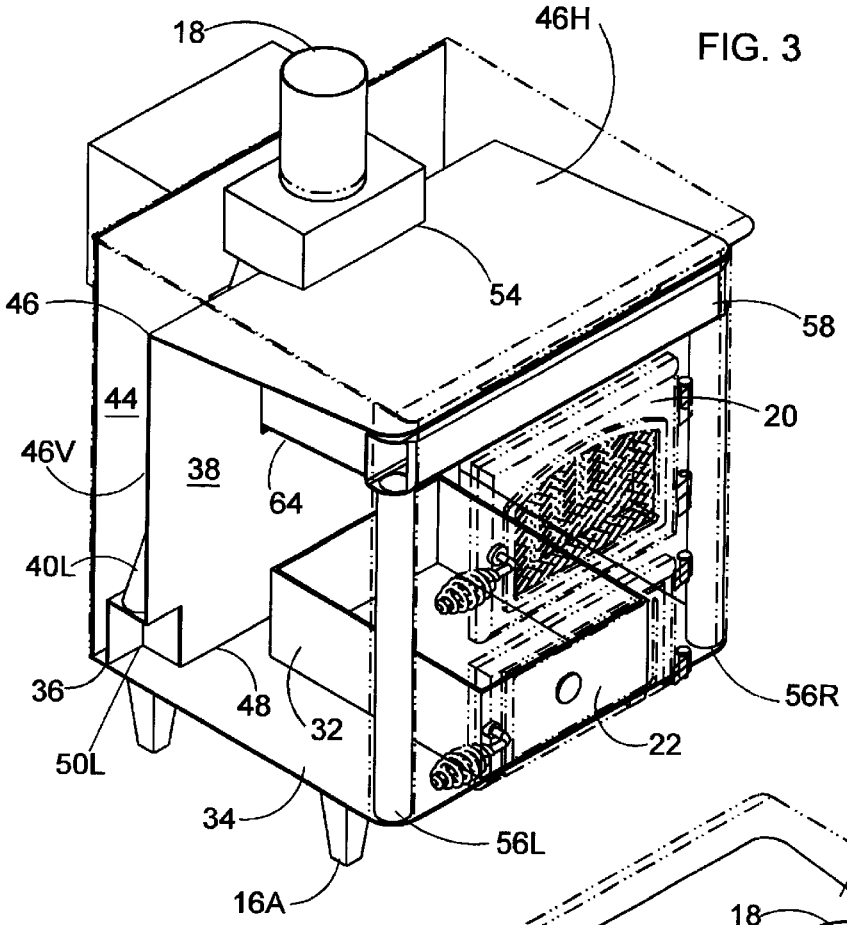
FIG. 3 is a front face, perspective view of the stoker with certain outer elements seen in phantom.

In the rearward perspective view of FIG. 2 are depicted the box-like coal hopper 24, underlying, box-like, air intake manifold, 26, and the associated convection air blower 28, which is typically a 265 CFM squirrel cage motor. Overlying is second intake air blower 30 of 50 CFM capacity. This smaller blower force feeds air to the firebox (not seen) at variable speeds to regulate combustion rate and heat output. Hopper 24 is spaced apart from manifold 26, and has its upper perimeter flush with the stoker top horizontal panel. the phantom modified perspective view of FIG. 3, is depicted an underlying ash box 32, resting on housing bottom panel 34, and within is normally closed (during coal combustion) hinged door 20. At the lower rear comer 36 of forward chamber 38 is a portal 40L (one of two), which receives combustion gases from the main chamber 38, which are directed to the lower longitudinal end of partially obscured tubular member 40L. This conduit member is located in a hermetically sealed rearward smaller chamber 44. A separate dividing member which defines the inner first and second chambers, 38 and 44, respectively, is an L-shaped bridging rigid panel 46, extending from the floor 34 of the housing along its lower linear edge 48 to the upper front panel 52 at its upper an leading linear edge. The configuration of the first and second chambers will be later described in detail.

As to rear chamber 44, the tubular members, 40L/R, each connect at their upper end with combustion gas collection manifold 54, (FIG. 4) which manifold, in turn, supports the lower end of combustion gases flue conduit 18.

Figure 4:
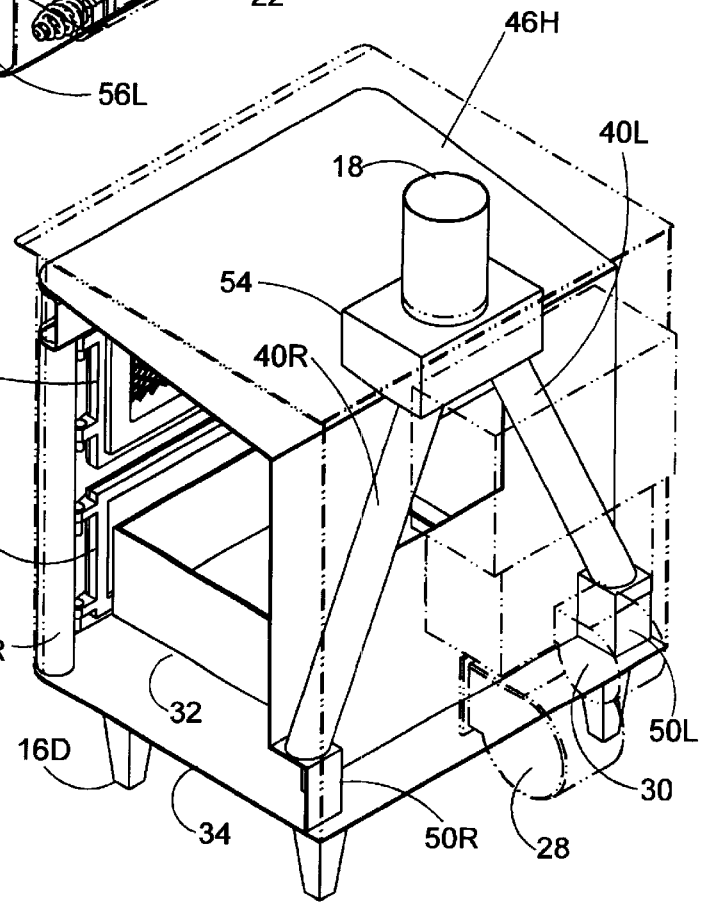
FIG. 4 is a rear face, perspective view also with certain outer elements seen in phantom.

The rear perspective view of FIG. 4 better depicts the air flow blowers 28/30, the paired inverted Y-shaped tubular members, 40L/R, the gases collection manifold 54, and the spent gases flue 18.

The perspective views of FIG. 3/4 also reveal certain of the internal components, like ash box 32, resting on planar bottom plate 34, and chimney 18, operatably connected to the upper surface of internal manifold 54. The transverse internal baffling panel, substantially an L-shaped configuration, is also adapted to receive coal stoker 64 in its vertical segment 46V, and overlies fire box 38.

In the front side, phantom perspective view of FIG. 3 are a pair of internal, upright tubular 56L/R, which connect functionally with front bridge box-like, elongate manifold 58, as will be described.

Figure 7A:
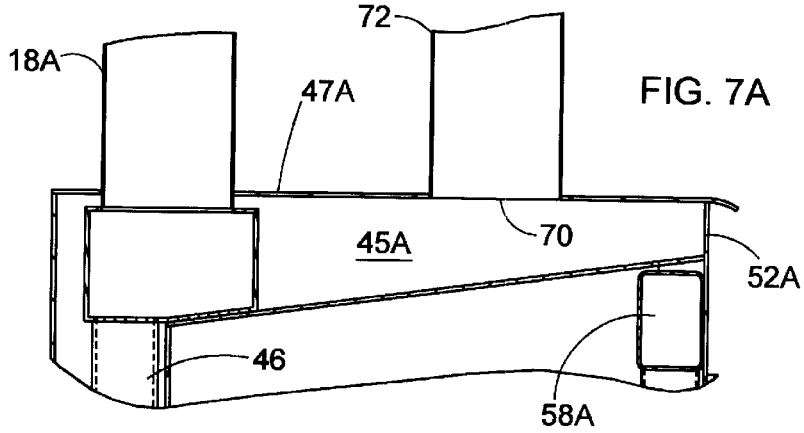
FIG. 7A is a broken out, side elevation of an alternate embodiment.
Figure 7:
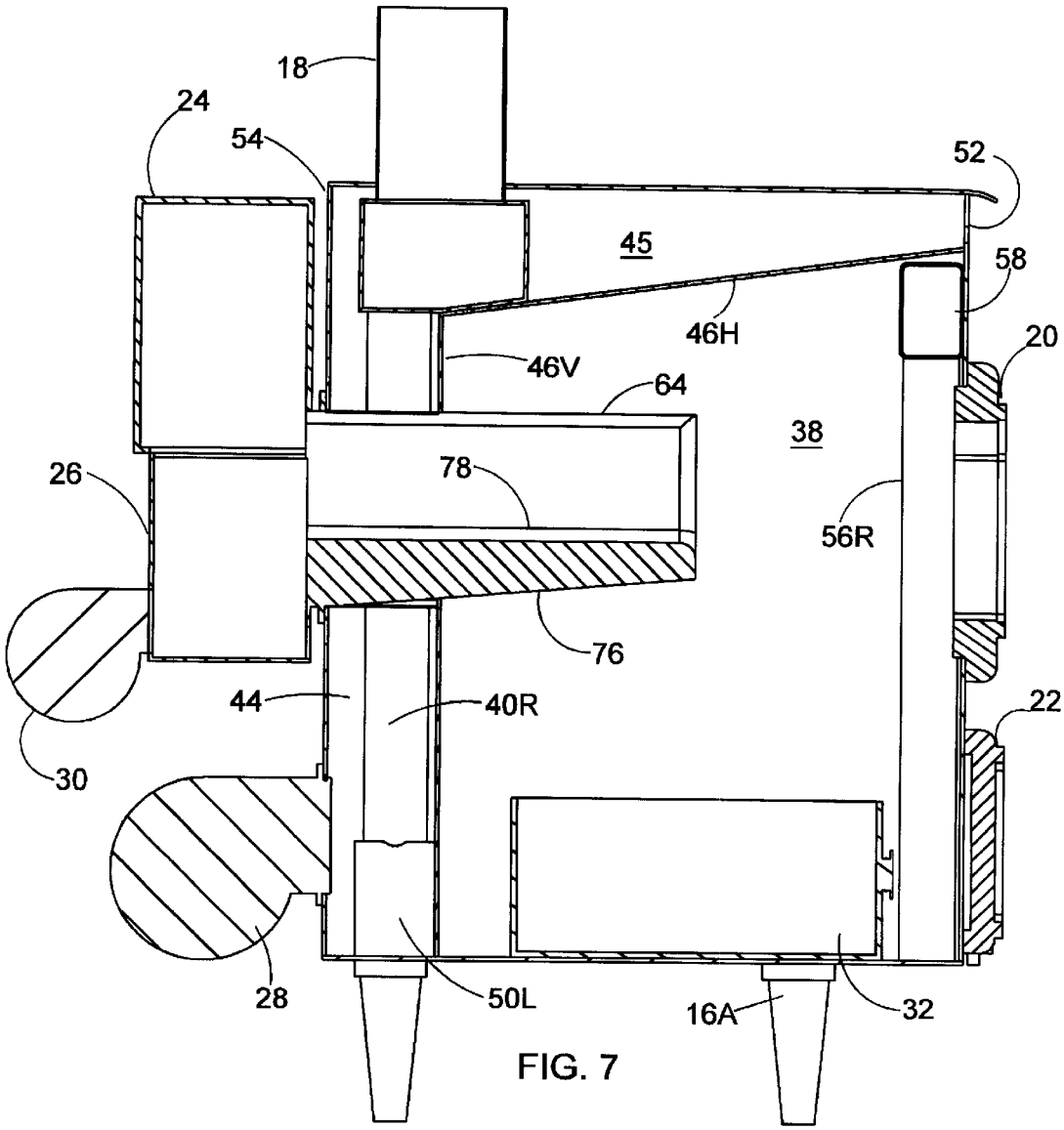
FIG. 7 is a vertical sectional view of the stoker (enlarged), taken along lines 7–7' of the stoker of FIG. 5.

Upper air blower 30 is located intermediate of the opposing tubular pair, 40L/R, and forces air to the undersurface of fire box stoker unit 76 (FIG. 7). The upper segment 46H of planar baffling plate 46 is sloped upwardly from rearward to frontward, forming an elongate horizontal passage 45 (FIG. 7) slot with planar top panel 47, which top panel supports the bridge manifold 54, and upwardly projecting chimney 18. The feet of the converged tubular members, 40L/R, are in open connection with the niches, ports 50L/R, located at the rearward two opposing back comers of the stove 12.

Figure 5:
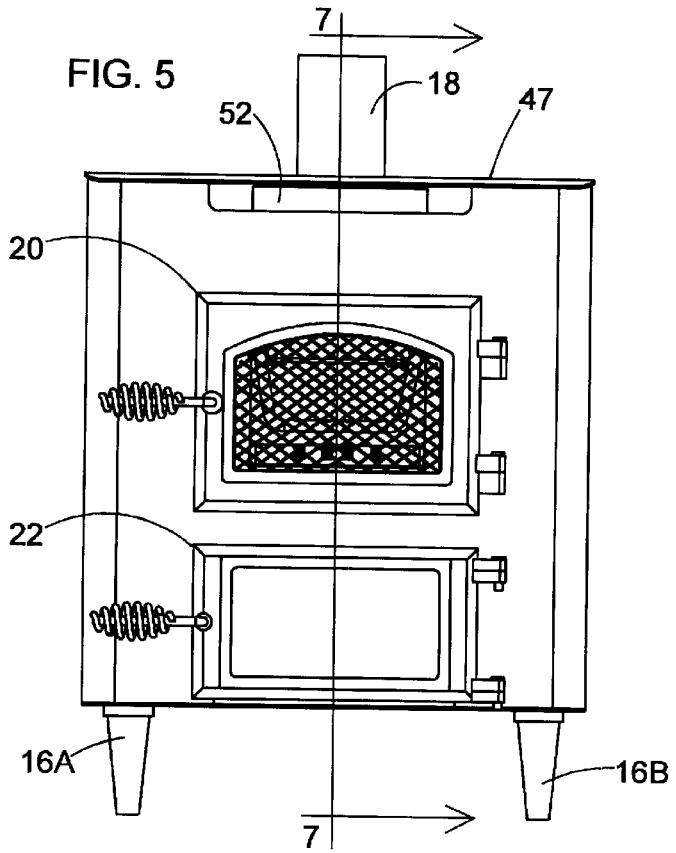
FIG. 5 is a front face, elevation view with the access doors closed.
Figure 6:
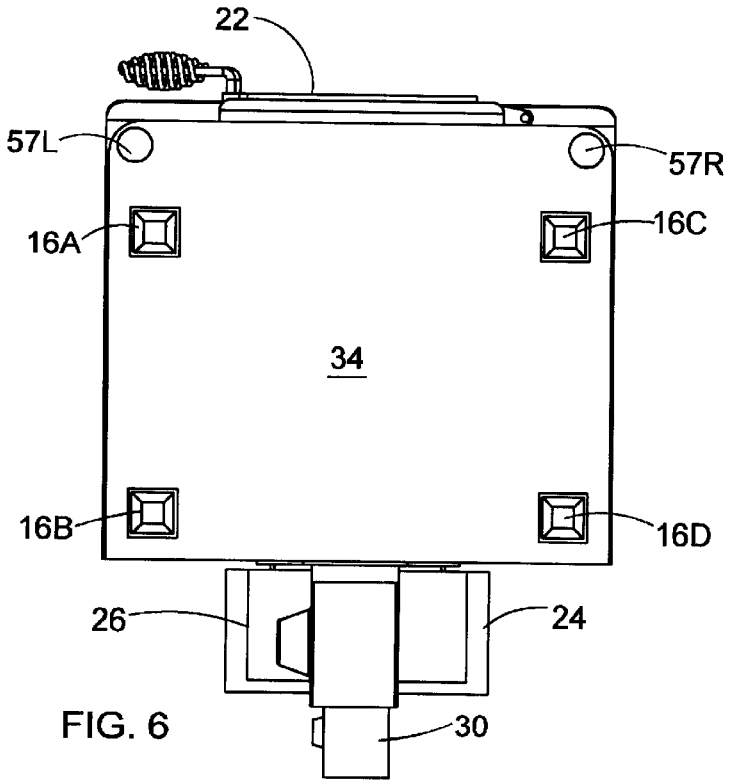
FIG. 6 is a bottom up plan view of the stoker, depicting the opposing air inlet ports of the front face vertical air inlet conduits.

The front elevational view of FIG. 5 depicts the stove 12 as it presents to the user, being oriented for operation with central flue 18 positioned and connected (not seen) to vent the heat-spent coal combustion gases. The bottom upward plan view of FIG. 6 depicts bottom plate 34, comer legs 16A/D, and front air intake ports, 56L/R. Blower 28 and its front handle on lower door 20 are seen. Coal hopper 24 and fire box 26 overlie blower 28. (FIG. 7)

In the vertical cross section view of FIG. 7 are shown all of the operative components in their functional juxtapositions, including flue 18 mounted on horizontal manifold 54; sensible heat outflow passage 45; elongate vent 52; front bridge box 58; and sloped tubular members, 40L/R, front face, tubular members, 56L/R, to horizontal tube 58; ash box 32, upper blower 30, and forced air passage 76 to the underside of firebox 64. Fire grate 78 projects horizontally into combustion chamber 38, receiving forced air flow from manifold 26. This innovation is described in my copending application, USSN 10/038,444, filed Jan. 7, 2002.

Regarding underside inlet ports, 57L/R, of FIG. 6 associated with front face conduits 56L/R of FIG. 3, these provide a washing and cleaning feature for combustion chamber glassed door 20. These conduits each have their lower longitudinal ends open to the ambient atmosphere, and draw in cooler ambient air to collect in bridging manifold 58. Manifold 58 is provided with a bottom side linear vent 62 (FIG. 9), which directs air flow laterally about glassed door 20, as is depicted in the flow lines of FIG. 9. Fire grate 78 is horizontally aligned, along with coal hopper 24, and vertical mounting plate is at right angles with 46V.

Lower blower 28 provides forced air flow to backward chamber 44, which air flows therethrough in heat exchange with sealed combustion gas conduits, 40L/R, disposed vertically in that chamber. The heated intake air is adapted to flow upwardly and outwardly through converging horizontal passage 45 and so to vent usefully to the environment of the stoker 12 via port 52.

Figure 8:
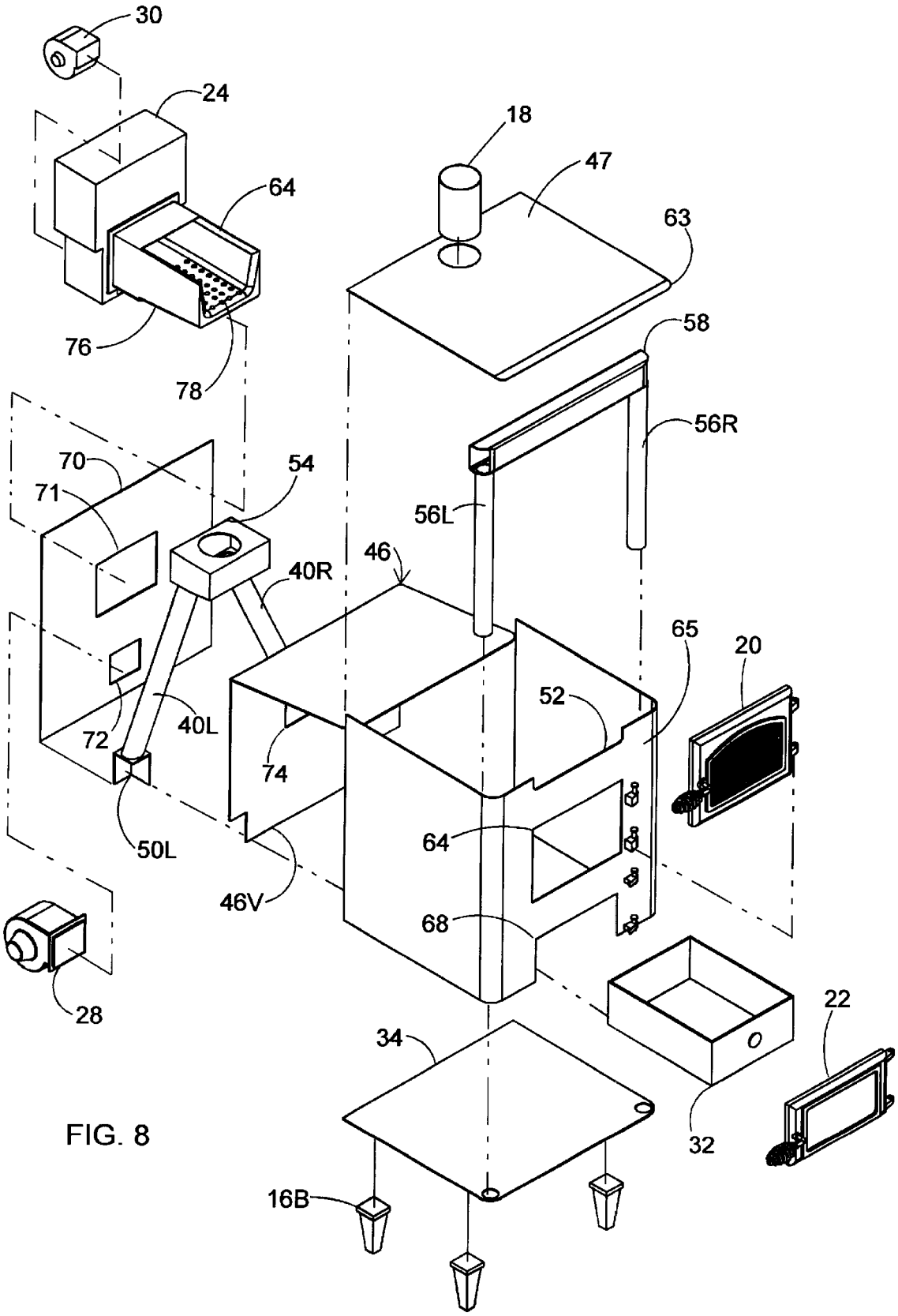
FIG. 8 is an exploded perspective view of all of the operative elements of the stoker and hopper still attached to the stoker unit.

In the exploded vertical view of FIG. 8, all of the stoker elements are depicted, including rear sidewall, central continuous cutouts, adapted to receive the firebox 64 projection into the operative stove body, and the downwardly sloped edge 63 of top panel 47 which serve to direct heated air from the stoker body into the ambient space.

On the forward facade of stove 12 is seen the cooler-washer subassembly, 58/56, and the front panel cutouts 64 and 68, which operatively connect to access doors, 20 and 22, respectively. Heat exchange, conduit assembly, 40L/R and 54, are disposed vertically between inner plate 44V that defines the first and second chambers, 38 and 44, respectively, and the back panel 70 provided with cutouts, 71 and 72, which accommodates fixedly stoker unit 24 and lower blower 28, respectively. The cutout 74 on vertical plate 44V receives the body of firebox 64 within larger chamber 38. Coal hopper 24 is mounted on the external surface of stove firebox 64. Underlying passage 76 feeds forced air to the fire grate 78 of firebox 64. Stoker housing 10 comprises three conjoining upstanding panels, with the front panel 65, adapted by cutouts to access the firebox and ash pan respectively.

Figure 9:
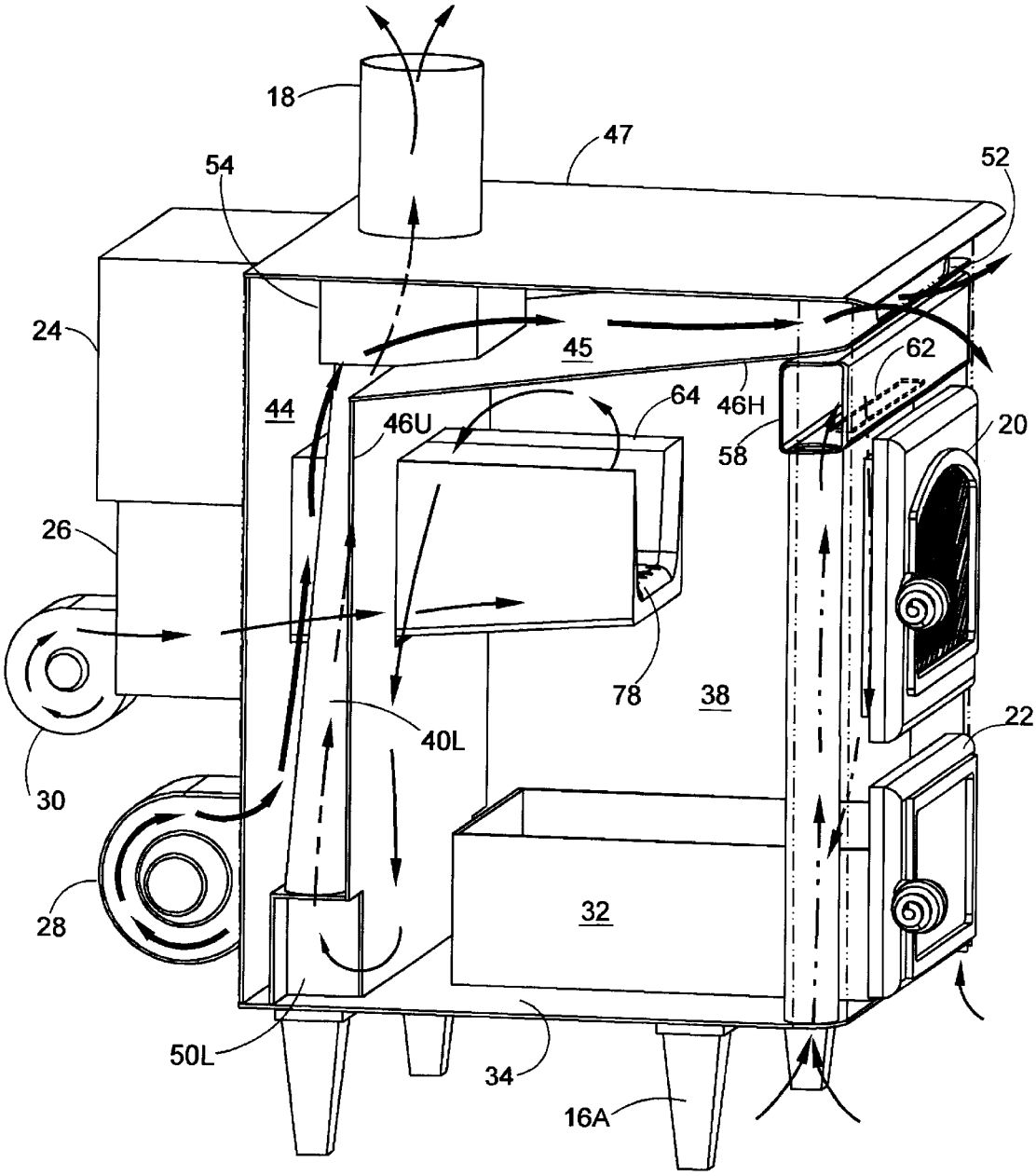
FIG. 9 is a schematic perspective view of the operative elements in situ, depicting the directional flow path of the heatable air through the stoker to area outflow.

Averting now to the opened-up perspective view of FIG. 9, the two forced air flows to the housing are graphically shown: of the combustion gases; of the induced convection air for enhanced sensible heat generation; and of the ancillary front panel, glassed, access door element, all of which are dynamically depicted. Combustion gases arising from firebox 64 are drawn as they cool somewhat, to the lowermost area of main chamber 38. They are then drawn through corner niches, 50L/R into combustion gas outflow conduits 40L and 40R, flowing upwardly to gas collection manifold 54, also set in back chamber 44, and then away from the inhabited area of the stoker via flue conduit 18.

Concurrently, the to-be-heated, but cooler air, indrawn via blower 28, flows directly to the lower section of back chamber 44, wherein that air effects a substantial heat exchange with combustion gases conduits disposed therein, 40L/R. Much sensibly heated air rises, and is drawn via lateral passage 45 of chamber 44 to outflow of the stoker housing itself, via slot vent 52, thereby providing added sensible heat to the room that has been newly extracted from the normally quite hot combustion gases that are continuously being vented. Typically, the flue gas temperature is reduced on the order of 100 degrees F. by the use of the present invention.

As to the ancillary, front panel cooling feature, ambient air is drawn upwardly at intake ports, 57L/R, (FIG. 6) into vertical conduits, 56L/R, and is combined in collection elongate manifold 58. The collected cooler air is vented downwardly via manifold bottom slot 62, along the lateral edges of upper door 20, cooling and air washing that access door to the combustion chamber. This feature minimizes any searing inadvertent contact of user with the hot glass element of the upper door, and also facilitates needed peaks at the firebox to confirm ongoing combustion of the automatic hopper deposited coal bed.

In a partial sectional view of FIGS. 7A, an alternative embodiment for sensible heat rerouting from outflow chamber 45A is depicted. All of the other elements are unchanged, but top plate 47A is modified to provide an outlet port 70 upon which is mounted fixedly, a heated air conduit 72. This alternate outlet serves to conduct a portion of the sensible heat air flow to another area to be warmed (not shown), while the mini-furnace is being operated at its maximum flow capacity. At lower air flow rates, intended only to warm the stoker immediate environment, an outlet port cover underlying the outflow conduit (not seen) can be rotated to shut off this outflow.

I claim:

1. In a motorized coal stoker housing including a coal feed hopper with a lower forward passage, a base box forming an ash pit, a rearward ramp adapted to receive coal from the bottom of the hopper, and a pusher assembly disposed in the lower forward passage, eccentric movement means operably connected to the pusher assembly for causing reciprocating action, and a forward fire grate for receiving particulate coal incrementally from the pusher means, the improvements comprising:

(a) the stove housing further comprising a larger and forward first chamber and a hermetically sealed smaller and rearward second chamber;

(b) the first chamber having closed sidewalls, a closed top wall, a front facing vertical panel perforated for intermittent user access, and a vertical inner back wall adapted to receive a coal stoker and coal firebox assembly;

(c) an exit portal means proximal the housing back wall and within the second chamber adapted to conduct coal combustion gases from the first chamber to:

(i) a first conduit means disposed in the second chamber and operatively interconnecting between the exit portal means and a flue conduit for cooled combustion gases, said first conduit means comprises a first pair of opposing tubular members separately connecting at the lower ends thereof with the exit portal means and jointly connecting the upper ends thereof with a first manifold located in the upper section of the second chamber, said first manifold being functionally connected to the flue conduit, such that venting combustion gases are precluded from leaking into the second chamber; and, (ii) a first blower means adapted to introduce forced air flow proximal to the bottom of the second chamber and to allow flow therethrough, so as to vent heated forced air proximal the upper and forward end of the second chamber and therefrom outwardly into the ambient surroundings.

2. In a motorized coal stoker housing including a coal feed hopper with a lower forward passage, a base box forming an ash pit, a rearward ramp adapted to receive coal from the bottom of the hopper, and a pusher assembly disposed in the lower forward passage, eccentric movement means operably connected to the pusher assembly for causing reciprocating action, and a forward fire grate for receiving particulate coal incrementally from the pusher means, the improvements comprising:

(a) the stove housing further comprising a larger and forward first chamber and a hermetically sealed smaller and rearward second chamber;

(b) the first chamber having closed sidewalls, a closed top wall, a front facing vertical panel perforated for intermittent user access, and a vertical inner back wall adapted to receive a coal stoker and coal firebox assembly;

(c) an exit portal means proximal the housing back wall and within the second chamber adapted to conduct coal combustion gases from the first chamber to:

(i) a first conduit means disposed in the second chamber and operatively interconnecting between the exit portal means and a flue conduit for cooled combustion gases, and said first means serving to exchange the sensible heat of the combustion gases with a contained forced air flow entering the second chamber, thereby to provide a heated forced air outflow to the uppermost end of the stove housing; the first conduit means further comprising a first pair of opposing tubular members disposed in the second chamber separately connecting at the lower longitudinal ends thereof with the bottom of the first chamber and jointly connecting the upper longitudinal ends thereof with a first manifold located in the upper section of the second chamber, which first manifold is functionally connected to a combustion gases exhaust flue conduit, such that venting combustion gases are precluded from leaking into the second chamber, (ii) a first blower means adapted to introduce forced air flow proximal to the bottom of the second chamber and to allow flow therethrough, so as to provide heated forced air proximal the upper and forward end of the second chamber and therefrom outwardly into the ambient surroundings; and, (iii) a second blower means located on the rear wall of the stoker housing for effecting forced air flow to the fire grate using an impeller fan.

3. The coal stoker of claim 2 wherein the second chamber has an inverted L-shaped configuration with a substantially horizontal upper leg comprising two planar panels adapted to converge on the front facing, vertical panel of the stoker housing and being adapted to engage with an exit portal positioned proximal to the uppermost top wall of the housing.

4. The coal stoker of claim 1 wherein the opposing tubular members of the second chamber each have open feet at the lower longitudinal ends thereof, which permit communication with the combustion gas environment of the first chamber and said pair have convergence at their upper longitudinal ends which connect with the exhaust flue conduit for the combustion gases.

5. The coal stoker of claim 1 wherein the fire grate component is aligned in a substantially horizontal configuration relative to an underlying ash pan element and with a free outer end of said grate overlying a point intermediate the ends of the ash pan.

6. The coal stoker according to claim 1 wherein the stoker includes a first means wherein the forced air flow to the fire grate is made variable per unit time.

7. The coal stoker according to claim 1 wherein the stoker includes a second means wherein the forced air flow to the second chamber first conduit means is made variable per unit time.

8. The coal stoker of claim 1 wherein a glass frontal door washing and cleaning assembly is provided adjacent the frontal panel of the stoker housing comprising:

(a) a first pair of formed conduits, one in each front comer of the front panel, each conduit having their lower longitudinal end open to the ambient atmosphere, and with their upper longitudinal ends connecting to a horizontal first manifold positioned intermediate of the uppermost end of the stove housing and an upper sill of a fire box exit door; and, (b) the first pair of formed conduits having their lower longitudinal ends positioned so as to direct the induced air flow along the lateral peripheries of the fire box access door for cooling and cleaning purposes.

9. The coal stoker of claim 1 wherein the first conduit means comprises formed tubular members.

10. The coal stoker of claim 1 in which the forward fire grate is substantially horizontal between the rearward ramp and the other longitudinal end thereof.

* * * * *